US006722922B2

(12) United States Patent
Cykon et al.

(10) Patent No.: US 6,722,922 B2
(45) Date of Patent: Apr. 20, 2004

(54) HEAVY DUTY ELECTRICAL CONNECTOR

(75) Inventors: James P. Cykon, Warren, OH (US); Leslie L. Jones, Garrettsville, OH (US); Ajay Bhargava, Boardman, OH (US); Robert C. Beer, Noblesville, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/112,955

(22) Filed: Apr. 2, 2002

(65) Prior Publication Data

US 2003/0186585 A1 Oct. 2, 2003

(51) Int. Cl.[7] ..... H01R 13/40

(52) U.S. Cl. ..... 439/587; 439/577; 439/277; 439/320; 439/319; 439/278

(58) Field of Search ..... 439/587, 577, 439/277, 320, 319, 278

(56) References Cited

U.S. PATENT DOCUMENTS

| | | | | | |
|---|---|---|---|---|---|
| 4,521,066 | A | * | 6/1985 | Kempe | 339/89 |
| 4,571,018 | A | * | 2/1986 | Annoot | 439/281 |
| 4,593,962 | A | * | 6/1986 | Knorreck et al. | 339/94 |
| 4,629,269 | A | * | 12/1986 | Kailus | 339/59 |
| 5,478,254 | A | * | 12/1995 | Holt | 439/275 |
| 5,604,440 | A | | 2/1997 | Tomikawa et al. | 324/539 |
| 5,743,754 | A | | 4/1998 | Cristich | 439/349 |
| 5,890,925 | A | | 4/1999 | Bernardini | 439/433 |

* cited by examiner

*Primary Examiner*—Truc Nguyen
(74) *Attorney, Agent, or Firm*—David P. Wood

(57) ABSTRACT

A multi-pin electrical connector including a first connector portion and a second connector portion. Seal retaining rings snapped into the connector portions seal and retain cavity terminal blocks located within each respective connector portion. A locking collar employs a ramped locking feature to snap and secure the first and second connector portions in an interlocked, assembled state. The multi-pin electrical connector can be composed entirely of non-metallic components.

15 Claims, 6 Drawing Sheets

HEAVY DUTY ELECTRICAL CONNECTOR

BACKGROUND OF THE INVENTION

The present invention relates to electrical wire connectors and more particularly, to multi-pin electrical wire connectors with a reduced number of component pieces, and, non-metal components.

Methods for attaching single or multiple wires to the rear end of a pin or socket contact which can be installed in an electrical connector, are well known in the art. Most of these methods require some type of tool to accomplish determination. Examples of existing methods to connect wires to the contact include soldering, crimping, wire wrapping, installation displacement, and compression of the wires between a screw or an anvil and terminal base.

U.S. Pat. No. 5,890,925 discloses an electrical connector with screw on or twist on electrical contacts. The contacts can be installed into their respective plug and receptacle housing bodies for the purpose of creating an electrical connector that can be mated and unmated many times to hook up and remove from service any electrical device or circuit.

U.S. Pat. No. 5,743,754 discloses an electrical multi-pin snap connector. The multi-pin snap connector includes a snap fastener stud with a multi conductor current carrying electrical plug. The stud interfaces with a new ring snap fastener socket which has a multi conductor current carrying electrical socket disposed within a hollow inside a fastener socket. A spring is held within the fastener socket and grips the stud when the pair are mated.

U.S. Pat. No. 4,744,770 describes a multi-pin electrical connector of which a ring provided on the plug body can not under any circumstance move angularly or on the plug body during the operation of assembly with a socket, to guarantee absolutely that the plug of the connector can, in any case, be assembled with it's socket.

Previously, many types of coupling methods have been used in endeavoring to provide an effective means for producing a positive, yet easily removable method of attaching and releasing multi-pin electrical connectors. The most common method is to utilize only the spring characteristics of a female connector, specifically a pair of female leaf spring sockets into which a solid male blade is inserted, correlative with household receptacles and appliance plugs.

Already known are electrical connectors which comprise a socket and a plug, each of which is composed of a socket body and a plug body, inside which there is housed a block of insulating material comprising the male and female connecting pins.

A ring is mounted on the plug body by being screw-threaded, or by means of cam slopes, so that rotation of the ring, engaged on ribs on the socket body simultaneously causes a plug body to move towards a socket body with maximum insertion of the male pins into the female pins.

In order to permit this assembly, the male and female pins occupy precise radial and angular positions so that each male pin can be placed in the axis of it's female pin, to the exclusion of any other position, and to this end, non-confusable grooves, are provided between the socket body and the plug body.

However, in order to permit assembly of the plug on the socket of this connector, it is furthermore necessary for the ring to occupy a precise angular position in relation to the plug on the socket. The plug body is itself in a position of maximum withdrawal in relation to it's ring for, if not, the ring would only be able to turn incompletely, which would give rise to an incomplete axial displacement of the plug body and therefore, an incomplete insertion of the male pins into female pins.

In the field of electronics, more positive methods have been adapted, such as coupling metal nuts that incorporate threads on a metal barrel and a captive fully threaded nut to draw the plug and socket together in a positive and forceful manner. Other round connectors utilize a metal nut that engages and locks with a quarter to a full turn. Spring loaded mechanisms have also been in use where the halves are pushed together and rotated with the spring holding them in contact in a bayonet type connection. Other spring devices attach the connectors by pushing together to mate, and then again pushing further to release the latch allowing separation.

However, the various multi-pin electrical connectors require numerous components in their construction. The very nature of these components cause a manufacturing concern, as well as sealing performance concerns once they are assembled together. In some instances, an adhesive is used in the secondary operation of the construction to ensure that a proper seal is achieved once the component parts are assembled for actual operation. Accordingly, there is a need in the art to provide a cost effective design that functions better or equal to the existing part, while reducing the number of piece components used in actual construction, and improving the overall assembled component sealing performance.

SUMMARY OF THE INVENTION

The present invention relates to a multi-pin electrical connector with a first connector portion and a second connector portion. The first connector portion includes a first connector housing; a multi-pin cavity block; a plurality of electrical connections located at a predetermined interior diameter of the first connector housing; and a seal retaining ring that is snapped into an end of the connector housing, thus forming a seal and retaining a cavity block within the connector housing. The second connector portion includes a second connector housing with the mating half of a multi-pin cavity block with raised ribs at predetermined locations within the interior diameter of the housing which match up with the connector or multi-pin cavity block openings of the first connector portion. A retaining ring snaps into an end of the second connector housing, and thus forms a diameter seal and retaining structure for the second cavity block within this connector housing. A locking collar is also provided in this second connector housing for connecting the first connector portion to the second connector portion.

In an embodiment of the invention, the multi-pin connector includes a locking collar which is snapped over a retaining flange on the connector housing. A connector retainer is also snapped into the housing to retain the cavity block and a cable seal. One of the cavity blocks utilizes a raised rib design to add an additional barrier engaging a face seal to enhance the sealing performance of the multi-pin connector. To ease in manufacturing and construction of the multi-pin connector, a non-metal material is used in the construction of the component parts. This design reduces the overall number of component pieces and eliminates the need for adhesive, as used in the prior art when using metal component parts.

BRIEF DESCRIPTION OF THE DRAWINGS

The various advantages of the present invention will become apparent to one skilled in the art by reading the following specification and subjoined claims, and by referencing the following drawings in which:

DETAILED DESCRIPTION OF THE INVENTION

Figure 1:
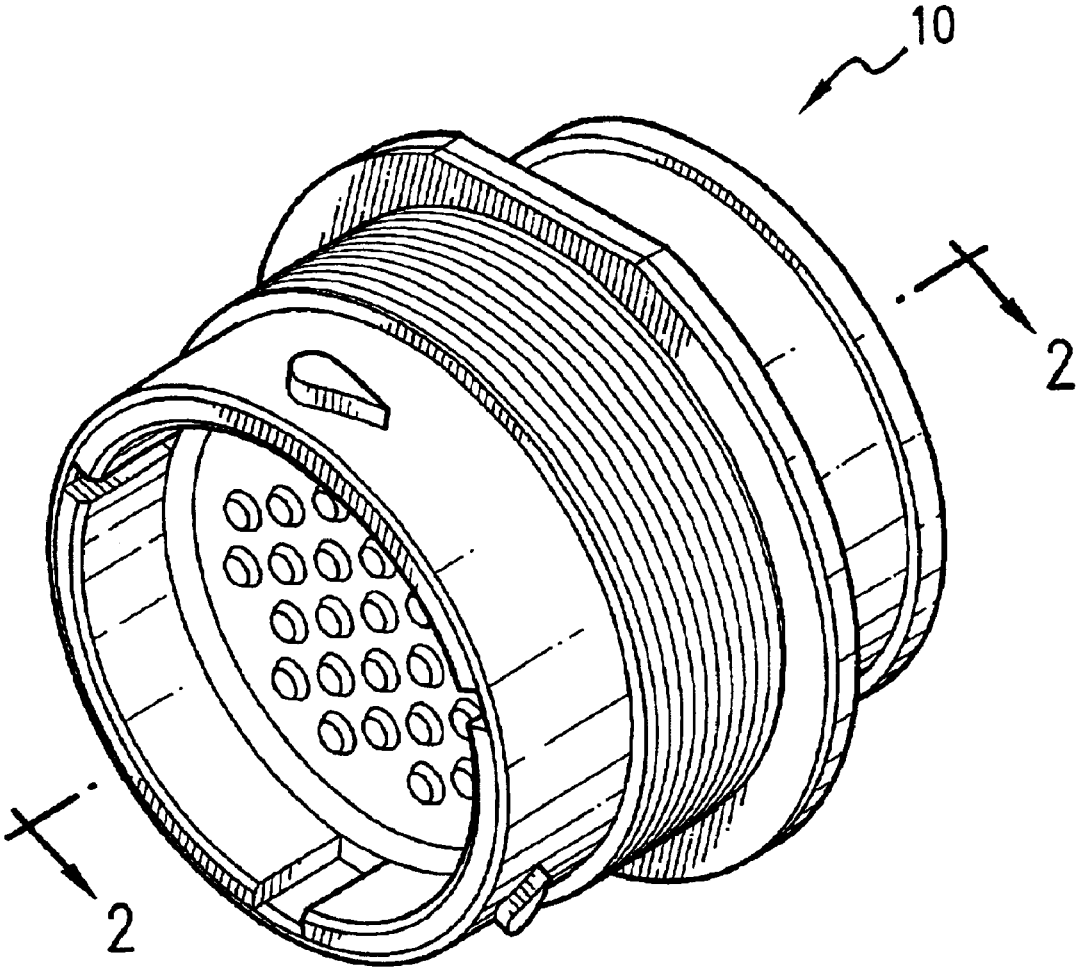
FIG. 1 is a simplified perspective drawing of a first connector portion.
Figure 2:
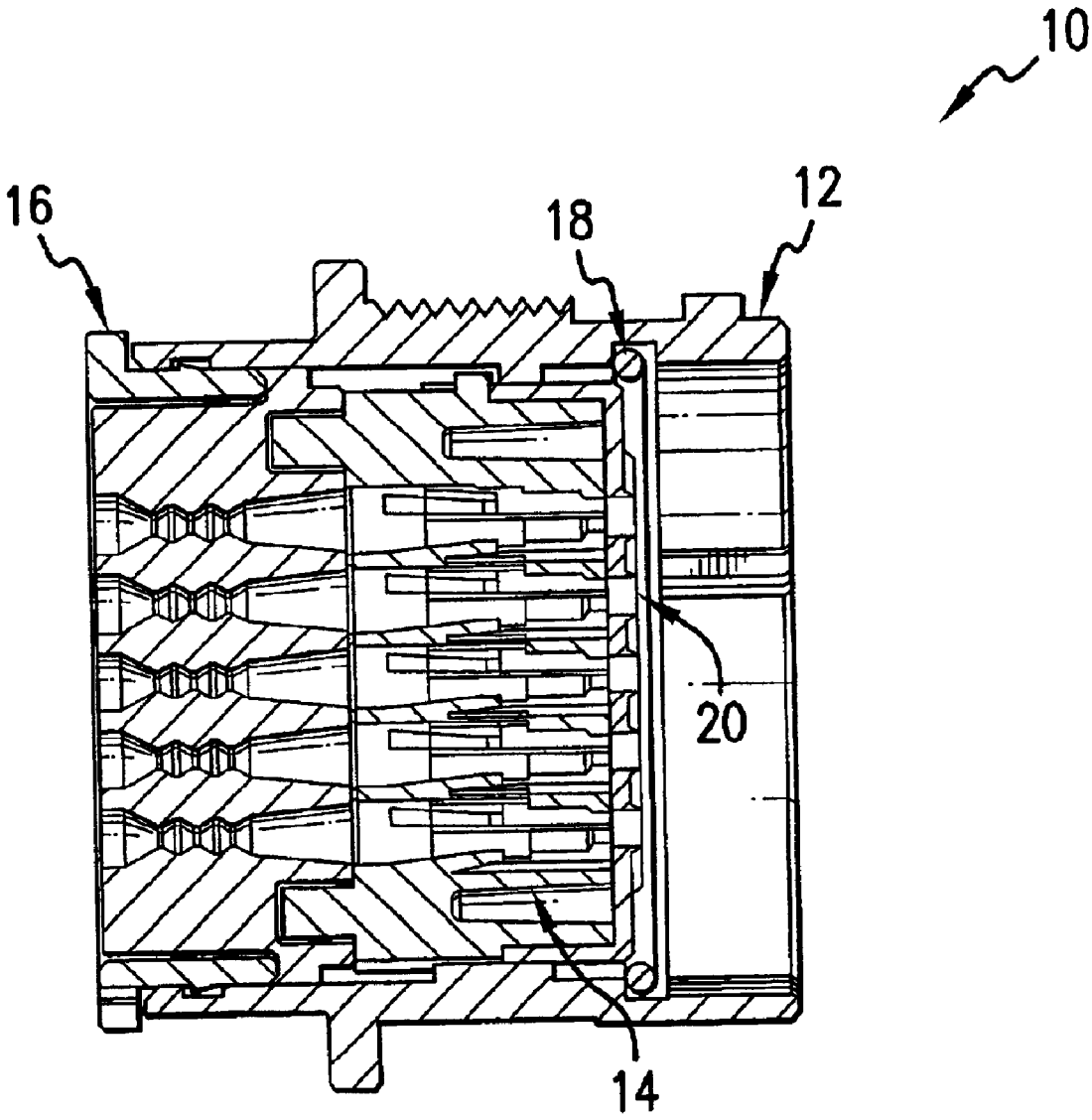
FIG. 2 is a cross sectional view of a first connector portion.
Figure 5:
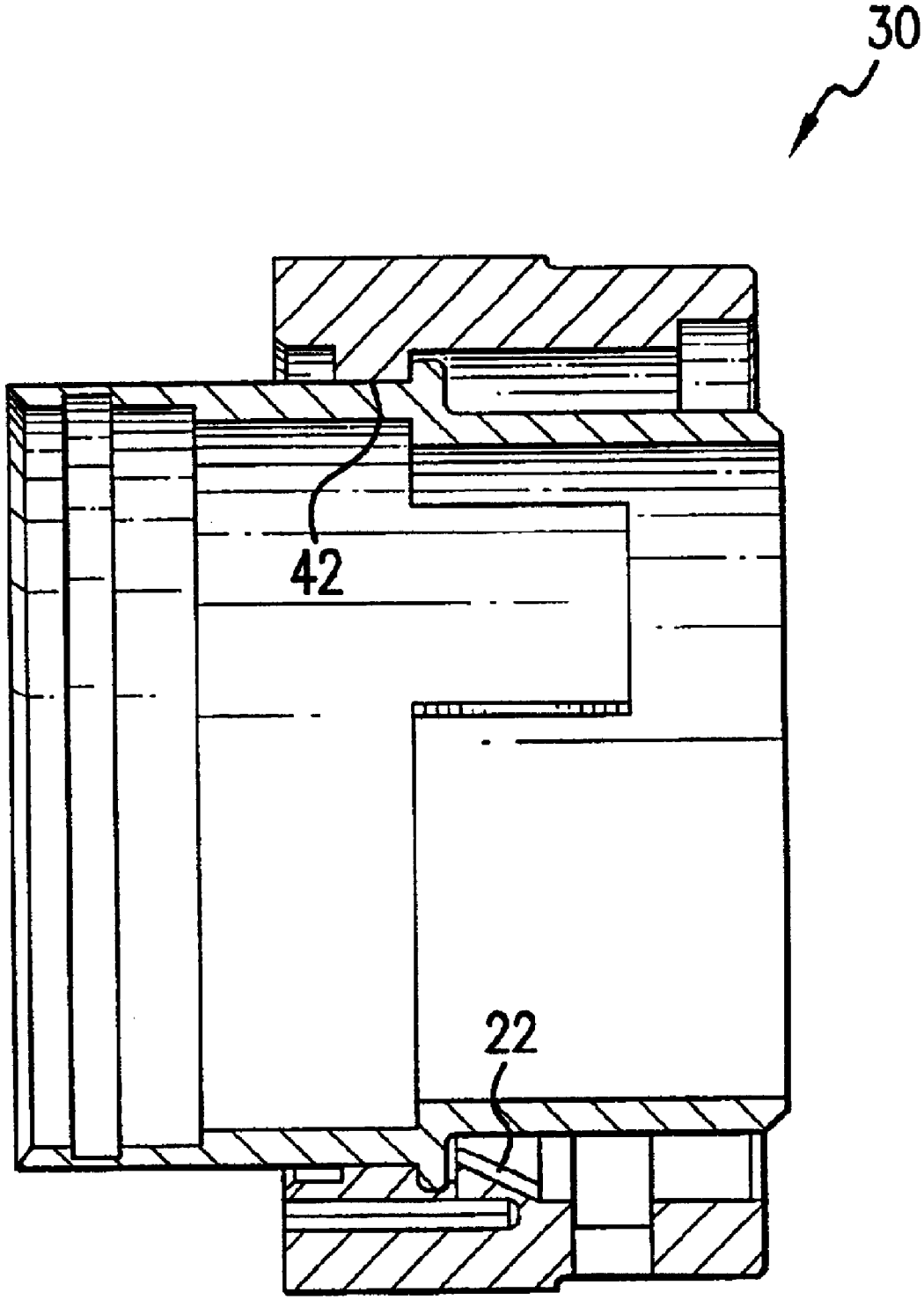
FIG. 5 is a sectional view of a second connector portion highlighting the locking collar ramping feature.
Figure 6:
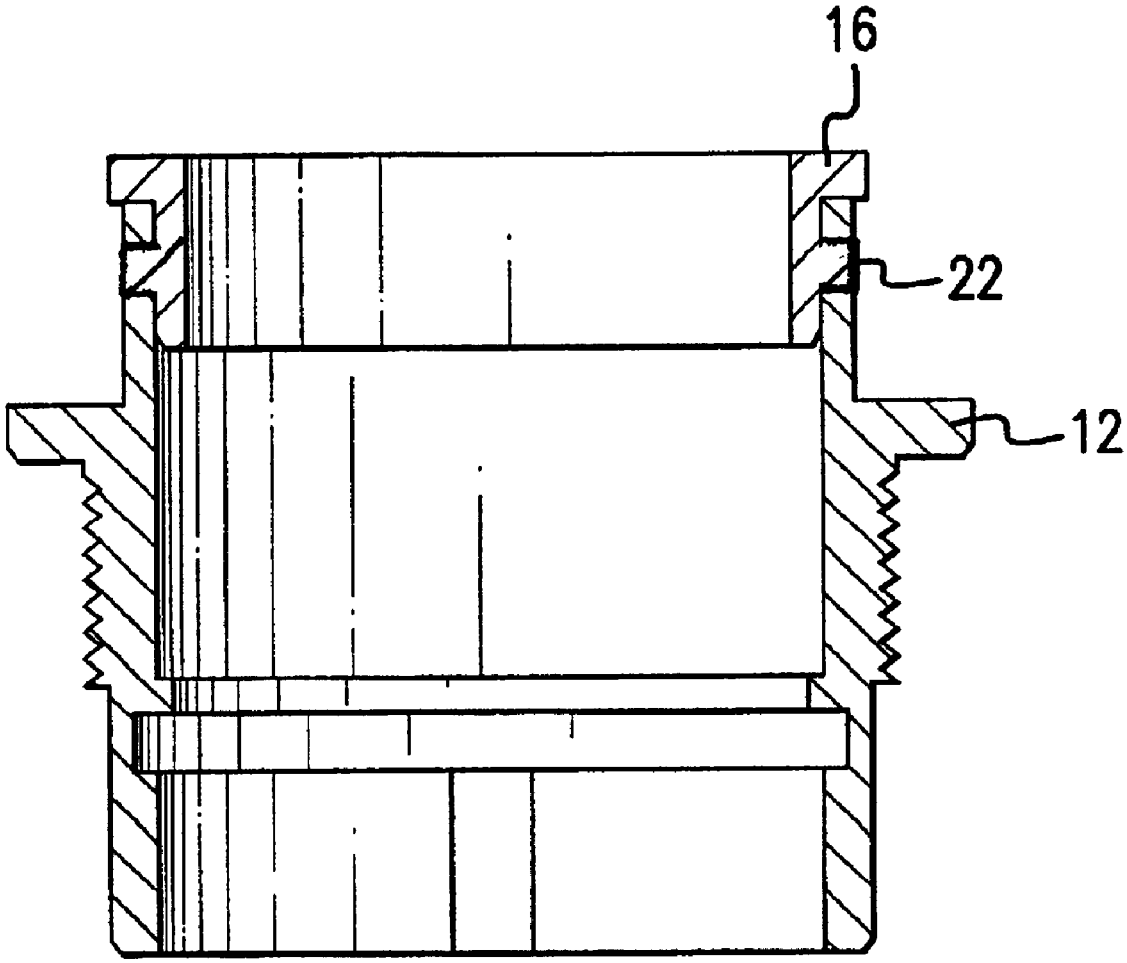
FIG. 6 is a cross-sectional view of a first connector portion with a first seal retaining ring installed.

FIGS. 1 and 2 illustrate a first connector portion 10 of a multi-pin electrical connector with a cylindrical configuration. The first connector portion 10 includes a first connector housing 12, a first multi-pin cavity block 14 for a plurality of electrical connections which is located at a predetermined interior diameter of the first connector housing 12. A first seal retaining ring 16 is snapped into a first end of the first connector housing 12 forming a diameter seal and retaining the first cavity block 14 within the first connector housing 12. The seal retaining ring 16 is secured by use of windows 17 in the first connector housing 12 by engaging rigid lock features (not shown) on the seal retaining ring 16. A circumferential peripheral seal 18 runs around an interior surface of the first connector housing 12. The first multi-pin cavity block 14 snaps into a first end of the first connector housing 12 and the peripheral seal 18 is located at the second end of the first connector housing 12. A face seal 20 is located juxtaposed to the peripheral seal 18 to also aid in the sealing of the component parts of the first connector portion 10 from the environment, thus eliminating the need for adhesive, as used in metal counterparts. Ramped detents 22 (see FIG. 5) are located at predetermined locations along an outer circumference of the second end of the first connector housing 12 for future connection with the second connector portion 30.

Figure 3:
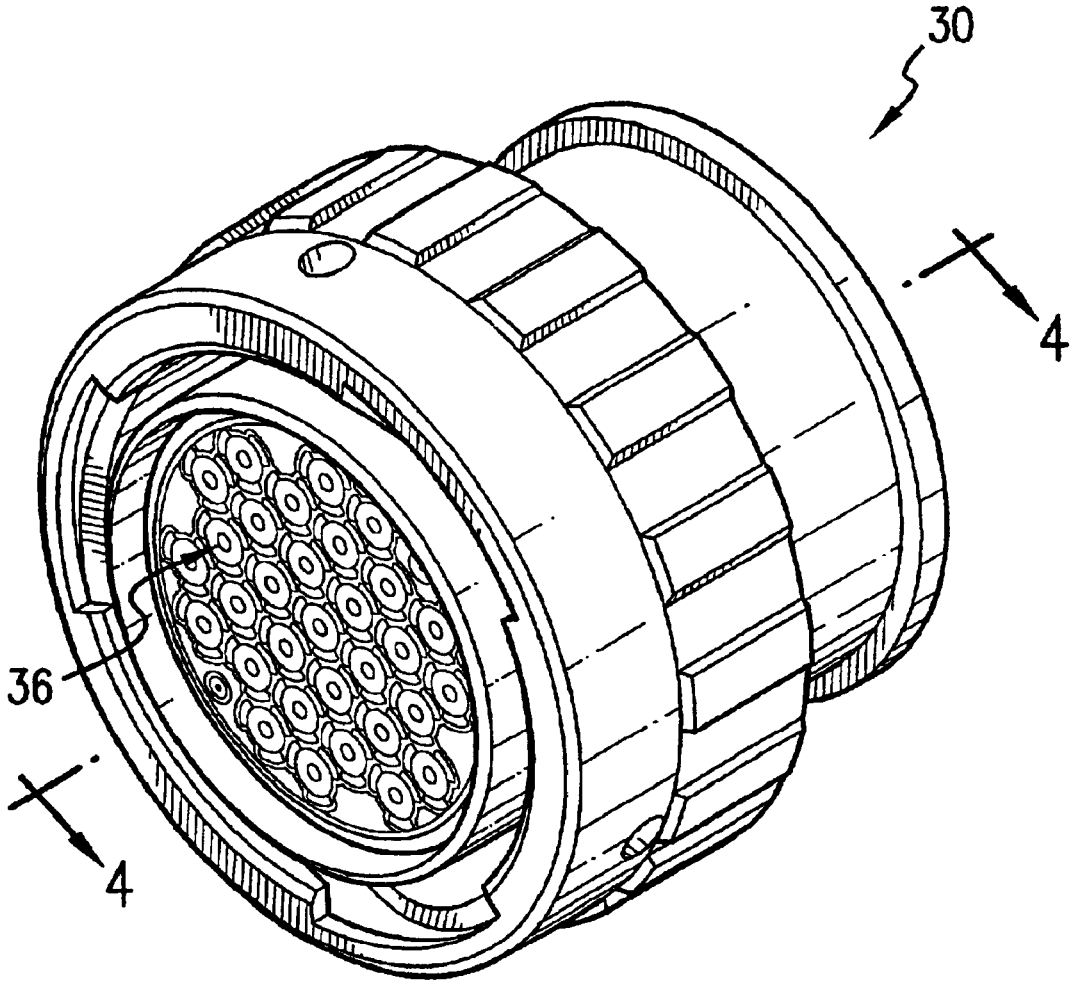
FIG. 3 is a simplified perspective of a drawing of a second connector portion.
Figure 4:
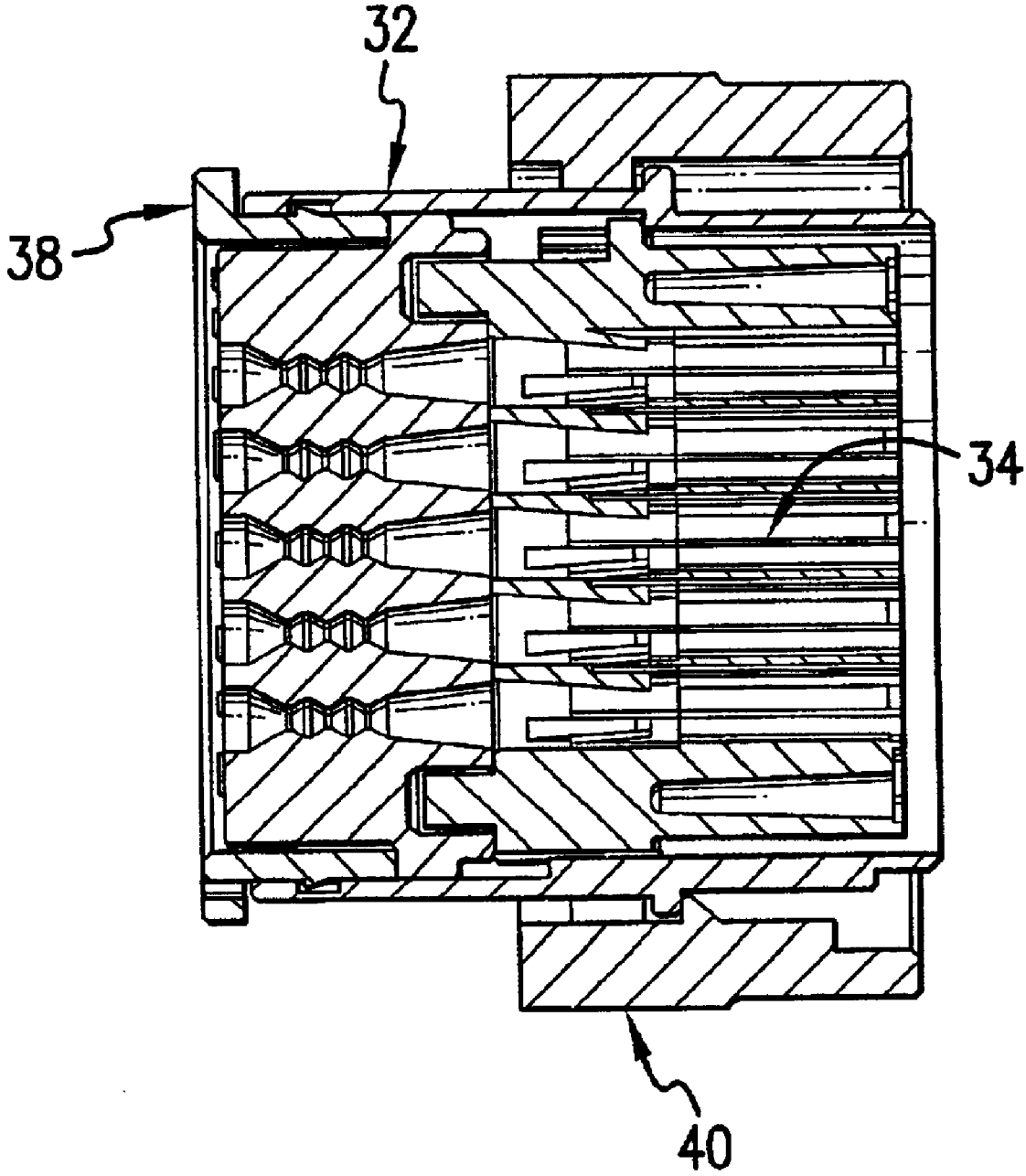
FIG. 4 is a cross-sectional view of a second connector portion.

FIGS. 3 and 4 illustrate the second connector portion 30. The second connector portion 30 includes a second connector housing 32 second multi-pin cavity block 34 with raised ribs 36 located at a predetermined interior diameter of the second connector housing 32. These ribs 36 are for a mating connection with the first multi-pin cavity block 14 when both first and second connector portions 10, 30 are interlocked together. A second seal retaining ring 38 snaps into the first end of the second connector housing 32 forming a seal and retaining the second cavity block 34 within the second connector housing 32. A locking collar 40 is located at a second end of the second connector housing 32. The locking collar 40 locks the first connector portion 10 to the second connector portion 30 in an interlocking fashion. The locking collar 40 includes interiorly situated circumferential indentations 42 at predetermined locations for interlocking with the ramped detents 22 of the first connector housing 12, thus joining and interlocking the first and second connector portions 10, 30. The locking collar 40 is snapped over a flange 44, which runs around a perimeter of the second connector housing 32 by pushing the indentations 42 over the flange 44. The locking collar 40 is then captured by the flange 44 in a ramping feature type construction (see FIG. 5). Delphi Automotive Systems™ has designed a commercial version of the presently disclosed invention as an upgrade to their existing Herculean Connection System.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A multi-pin electrical connector comprising:

a first connector portion and a second connector portion;

said first connector portion including a first connector housing, a first multi-pin cavity block for a plurality of electrical connections located at a predetermined interior diameter of said first connector housing, and a first seal retaining ring snapped into a first end of said first connector housing sealing and retaining said first cavity block within said first connector housing; and said second connector portion including a second connector housing, a second multi-pin cavity block with protrusions located at a predetermined interior diameter of said second connector housing for mating connection with said first multi-pin cavity block, a second seal retaining ring snapped into a first end of said second connector housing sealing and retaining said second cavity block within said second connector housing, and a locking collar at a second end of said second connector housing for connecting said first connector portion to said second connector portion.

2. The multi-pin electrical connector according to claim 1, wherein said first and second connector portions are cylindrical.

3. The multi-pin electrical connector, according to claim 2, wherein ramped detents are located in predetermined locations along an outer circumference of a second end of said first connector housing.

4. The multi-pin electrical connector, according to claim 3, wherein said locking collar includes interiorly situated circumferential indentations at predetermined locations for interlocking with said ramped detents thus joining said first and second connector portions.

5. The multi-pin electrical connector, according to claim 4, wherein said ramped detents are interlocked with said indentations.

6. The multi-pin electrical connector, according to claim 5, wherein said locking collar is snapped over a flange which runs around a perimeter of said second connector housing by pushing said indentations over said flange.

7. The multi-pin electrical connector, according to claim 2, wherein said first and second seal retaining rings snap into windows at predetermined locations on interior surfaces of said first and second connector housings, respectively.

8. The multi-pin electrical connector, according to claim 1, wherein said first and second connector portions are non-metal.

9. A multi-pin electrical connector comprising:

a first connector portion and a second connector portion;

said first connector portion including a first connector housing, a first multi-pin cavity block for a plurality of electrical connections located at a predetermined interior diameter of said first connector housing, and a first seal retaining ring secured to a first end of said first connector housing sealing and retaining said first cavity block within said first connector housing; and said second connector portion including a second connector housing, a second multi-pin cavity block, a second seal retaining ring secured to a first end of said second connector housing sealing and retaining said second cavity block within said second connector housing, and a locking collar at a second end of said second connector housing for connecting said first connector portion to said second connector portion.

10. The multi-pin electrical connector according to claim 9, wherein said first and second connector portions are cylindrical.

11. The multi-pin electrical connector, according to claim 10, wherein ramped detents are located at predetermined locations along an outer circumference of a second end of said first connector housing.

12. The multi-pin electrical connector, according to claim 11, wherein said locking collar includes interiorly situated circumferential indentations at predetermined locations for interlocking with said ramped detents thus joining said first and second connector portions.

13. The multi-pin electrical connector, according to claim 12, wherein said ramped detents are interlocked with said indentations.

14. The multi-pin electrical connector, according to claim 13, wherein said locking collar is snapped over a flange which runs around a perimeter of said second connector housing by pushing said indentations over said flange.

15. The multi-pin electrical connector, according to claim 10, wherein said first and second seal retaining rings snap into windows at predetermined locations on interior surfaces of said first and second connector housings, respectively.

* * * * *